US006964366B2

(12) United States Patent
Peng et al.

(10) Patent No.: US 6,964,366 B2
(45) Date of Patent: Nov. 15, 2005

(54) MAILBOX WITH LIGHTING DECORATIVE STRUCTURE

(75) Inventors: Chi-Tsung Peng, Hsin-Chu (TW); Sheng-Te Liu, Hsin-Chu (TW)

(73) Assignee: Baycom-Electronics Technology Co., Ltd., Hsin-Chu (TW)

( * ) Notice: Subject to any disclaimer, the term of this patent is extended or adjusted under 35 U.S.C. 154(b) by 48 days.

(21) Appl. No.: 10/727,293

(22) Filed: Dec. 2, 2003

(65) Prior Publication Data

US 2005/0116019 A1 Jun. 2, 2005

(51) Int. Cl.[7] ..... B65D 91/00
(52) U.S. Cl. ..... 232/38; 40/547; 40/566
(58) Field of Search ..... 232/38, 17, 45; 40/566, 547; 362/806, 812

(56) References Cited

U.S. PATENT DOCUMENTS 5,460,325 A * 10/1995 Surman ..... 232/17
5,522,540 A * 6/1996 Surman ..... 232/17
6,023,869 A * 2/2000 Durbin ..... 40/544
6,076,294 A * 6/2000 Durbin ..... 40/544
6,367,180 B2 * 4/2002 Weiss et al. ..... 40/580
6,708,876 B1 * 3/2004 Shirah ..... 232/38
6,719,193 B2 * 4/2004 Katulka ..... 232/38
6,745,507 B2 * 6/2004 Golding ..... 40/564
2002/0017045 A1 * 2/2002 Weiss et al. ..... 40/580

* cited by examiner

*Primary Examiner*—William L. Miller

(57) ABSTRACT

A mailbox with lighting decorative structure, on an upper face or side face of the mailbox is installed with a lighting fixing structure of a different shape. The lighting fixing structure of different shape is installed with a specified number of lighting boards with different letter fonts or patterns. The lighting board is a combination of plastic optical fibers with letter fonts or patterns or different structures. The lighting fixing structure is connected with a circuit board, a solar energy board and a battery, producing lighting effects to the letter fonts or patterns on the mailbox at nighttime or on cloudy days.

3 Claims, 14 Drawing Sheets

MAILBOX WITH LIGHTING DECORATIVE STRUCTURE

BACKGROUND OF THE INVENTION

1. Field of the Invention

The present invention relates to a mailbox with a lighting decorative structure, particularly a mailbox consisted of lighting fixing structures of different shapes and lighting boards of different structures that are combined to make a mailbox with lighting decorative effects.

2. Description of the Prior Art

Generally, a mailbox is made of wood or metal and cannot be easily seen by people at night. So the mailbox is often run over by cars. On the other hand, a regular mailbox does not emit light on the address, if there is one, on the mailbox to facilitate identification. That is a shortcoming that needs improvement.

SUMMARY OF THE INVENTION

The primary objective of the invention is to provide a mailbox with a lighting decorative structure, consisting of different lighting structures and different lighting board structures, characterized in that: the lighting board structure consists of one of the following: (1) lighting board and connecting board 3, (2) fixing plate and membrane, and (3) bottom plate, optical fiber fabric, upper plywood and membrane. The lighting fixing structure consists of one of the following: (1) fixing main unit, upper cover and receptor unit, (2) fixing plate, optical fiber fabric and fixing frame, and (3) fixing main unit, fixing end face and base. The foregoing lighting fixing structure and lighting board structure is assembled and installed on a top face or side face of a mailbox, creating a lighting effect to the mailbox at nighttime or on cloudy days.

DETAILED DESCRIPTION OF PREFERRED EMBODIMENTS

Figure 1:
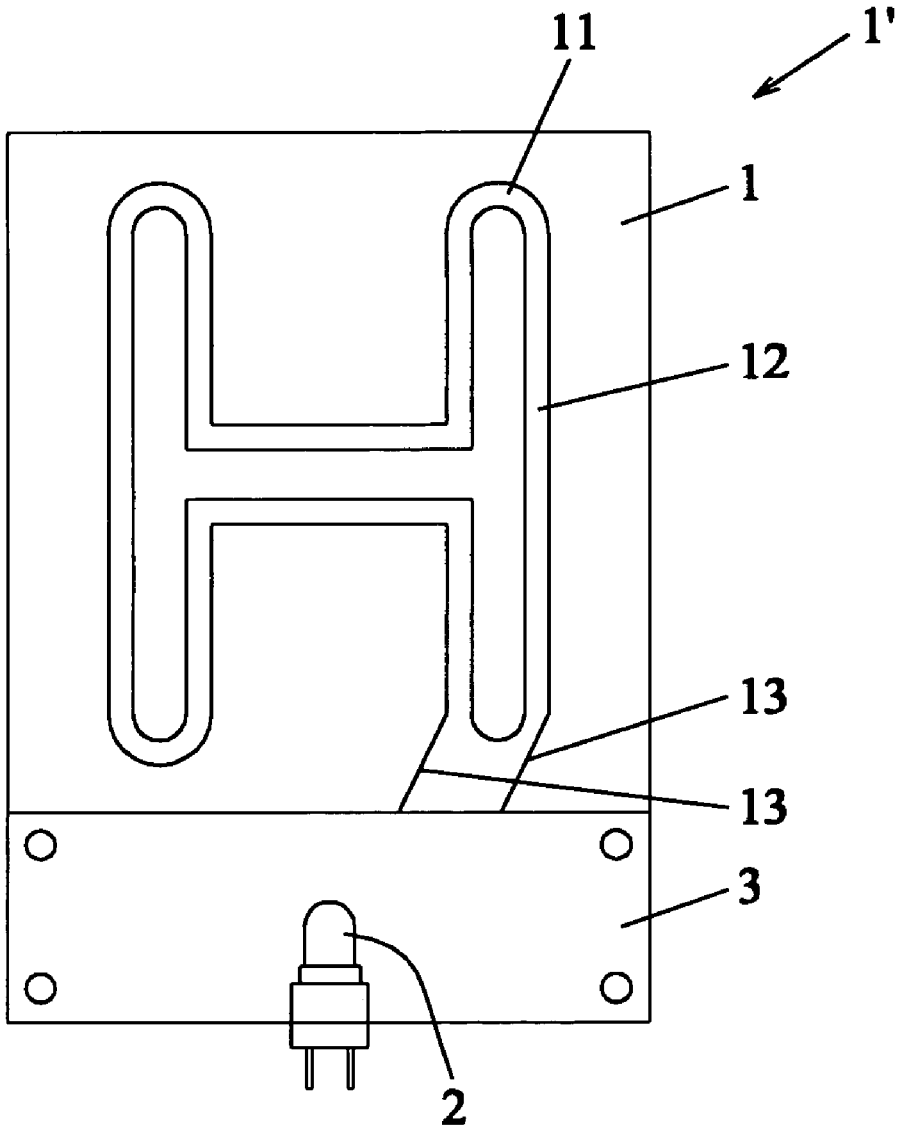
FIG. 1 is a first view of a lighting board structure of the present invention.
Figure 2:
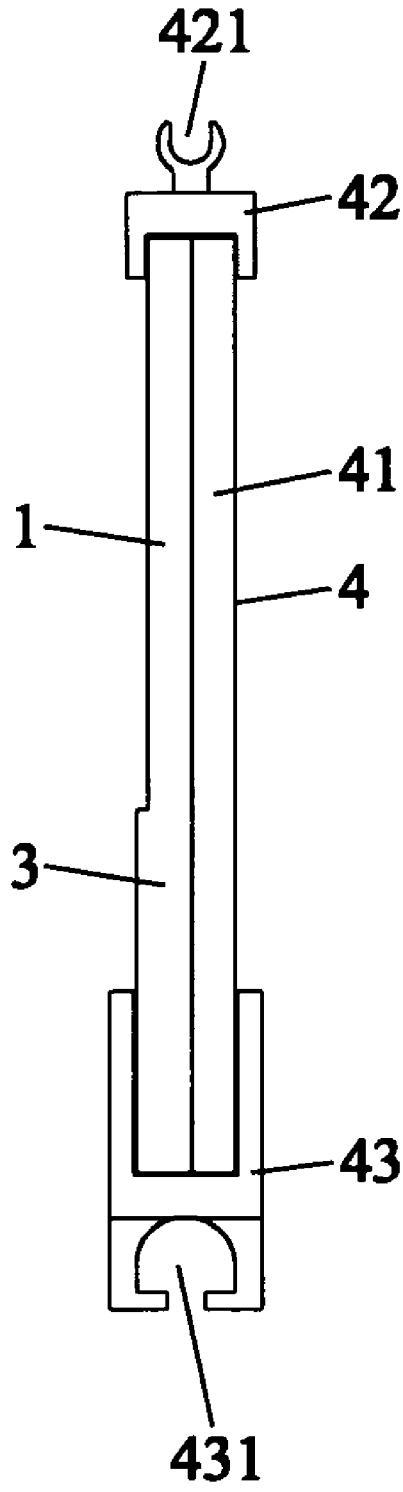
FIG. 2 is a side view of a lighting fixing structure of the present invention.
Figure 3:
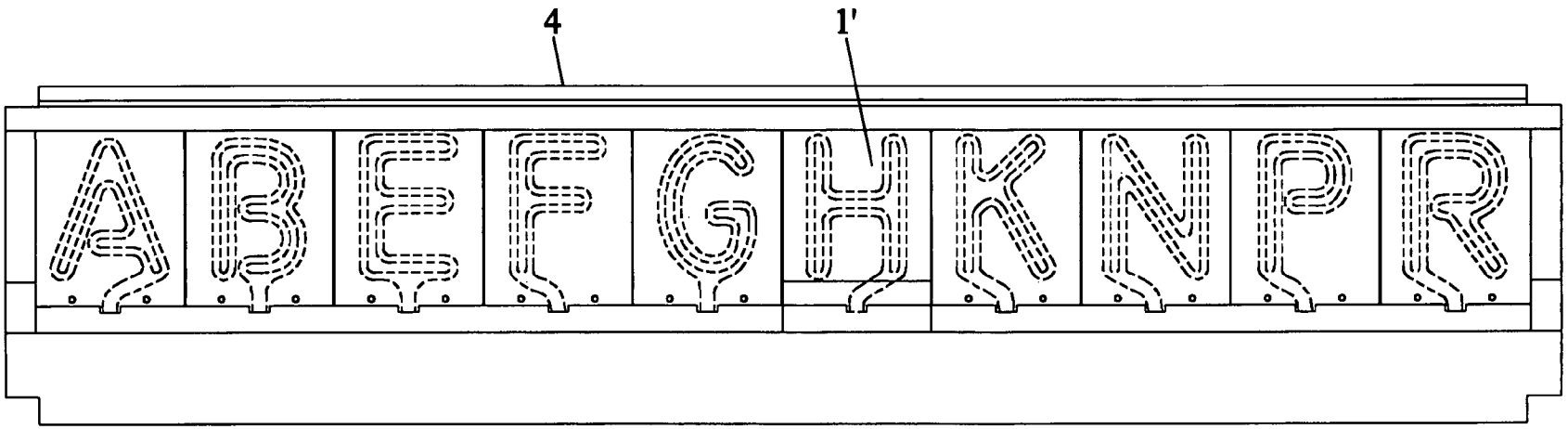
FIG. 3 is a front view of a lighting fixing structure of the present invention.
Figure 4:
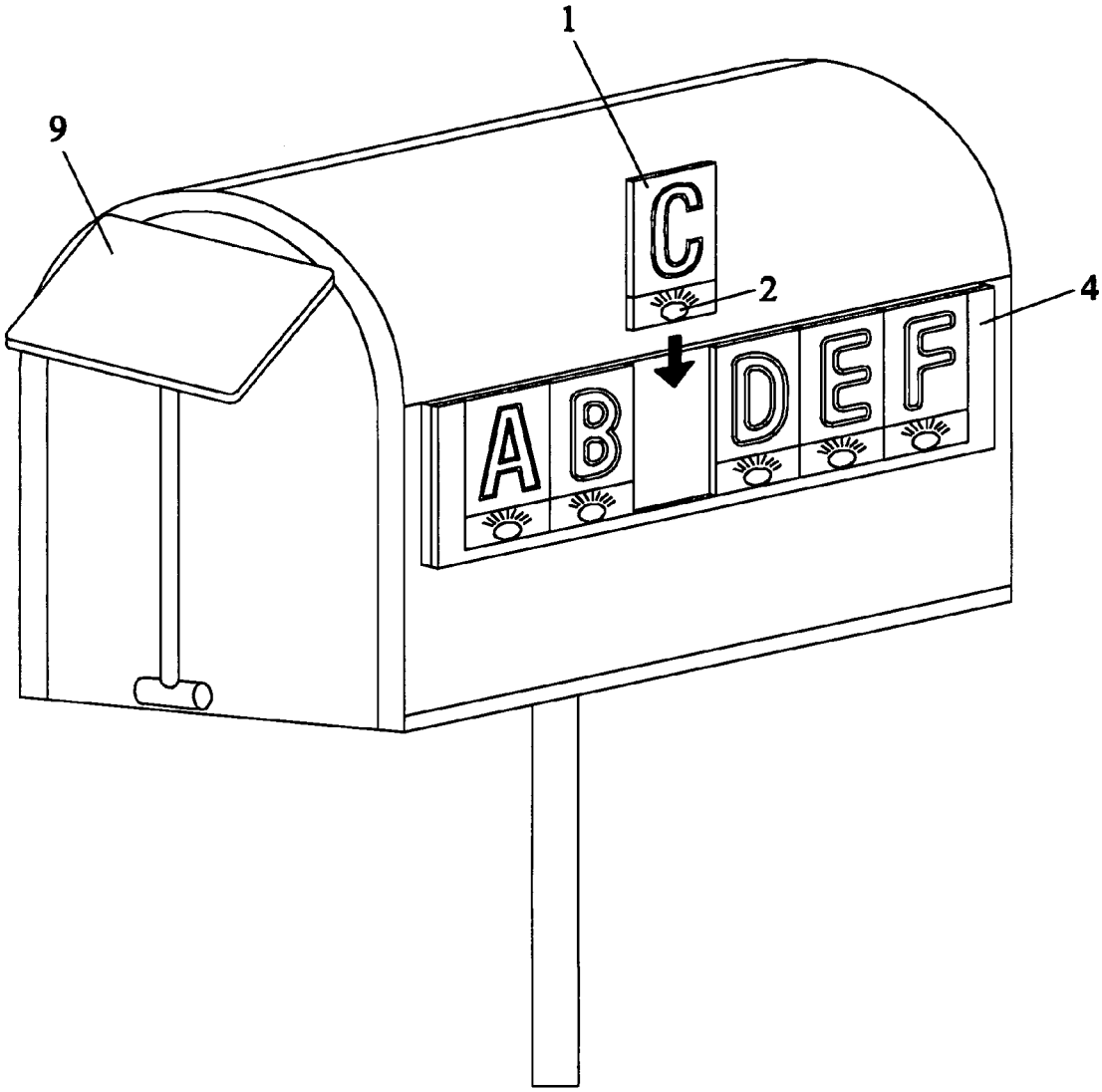
FIG. 4 is an embodiment view of the present invention.
Figure 5:
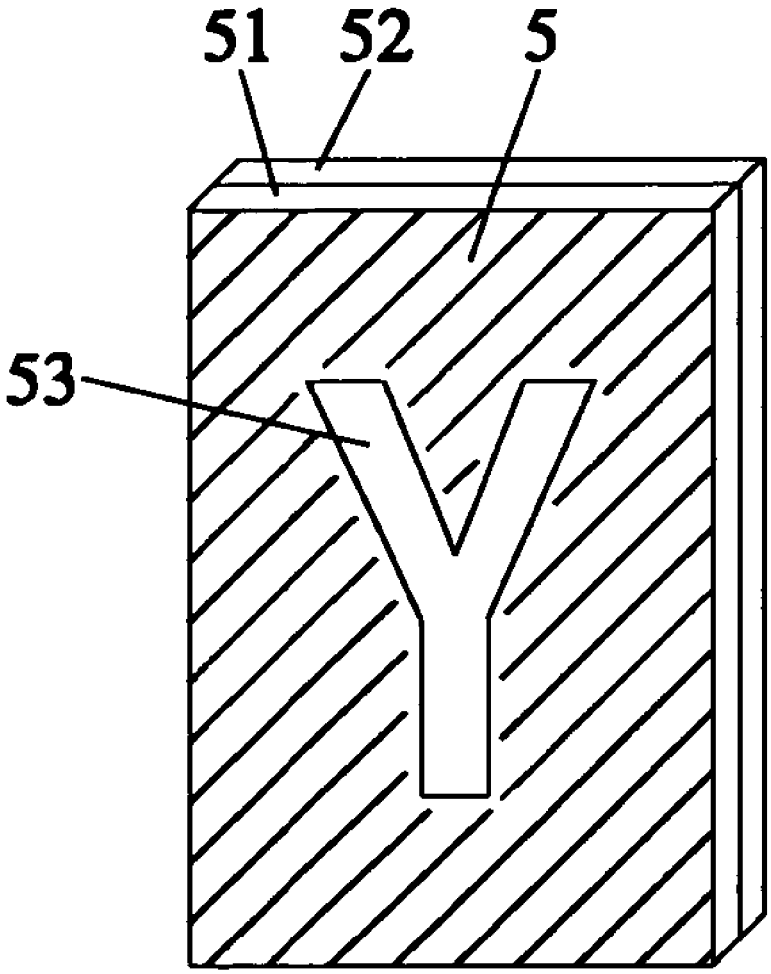
FIG. 5 is a second view of the lighting board structure of the present invention.

The present invention relates to a mailbox with lighting decorative structure, comprising of different types of lighting fixing structures 4 and different lighting board structures 1', as shown in FIGS. 1 to 3. The lighting board structure 1' consists of a lighting board 1 and a connecting board 3 combined together as one unit. A surface of the lighting board 1 has a deep end face 11 with a specified depth. An optical fiber filament 12 is made to suit the shape of the deep end face 11 before the optical fiber filament 12 is inserted thereto. A lower part of the deep end face 11 is connected with a connecting board 3 and a center part is installed with a lighting unit 2. As shown in FIG. 2, the lighting fixing structure 4 consists of a fixing main unit 41 and a top cover 42 and a receptor unit 43. On a top part of the upper cover 42 is installed a round head 421, on a lower part of the receptor unit 43 is installed a receptor head 431. The lighting structure 1' is positioned between the upper cover 42, the receptor unit 43 and the fixing main unit 41, as shown in FIG. 3, lighting structures 1' of different letter fonts are placed inside the lighting fixing structure 4, as shown in FIG. 4 which illustrates an embodiment view of the present invention, wherein the lighting fixing structure 4 is fixed on an upper part of the mailbox, to provide practical use to the product.

Figure 6:
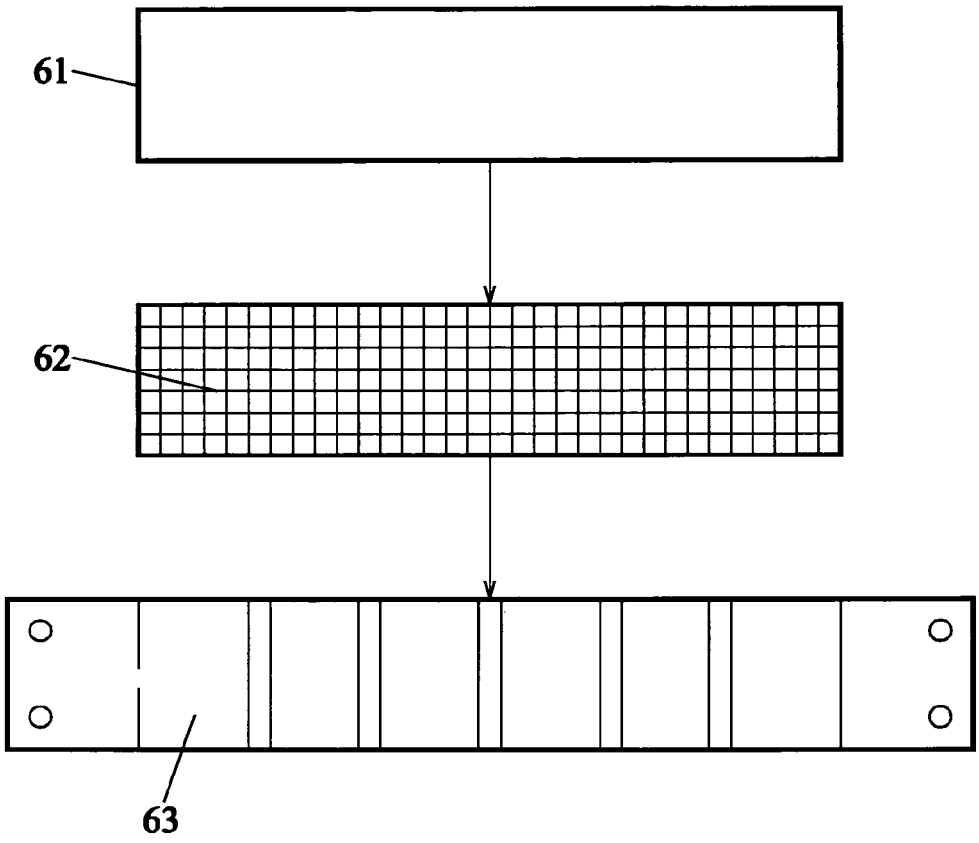
FIG. 6 is an assembled view of a lighting fixing structure of the present invention.
Figure 7:
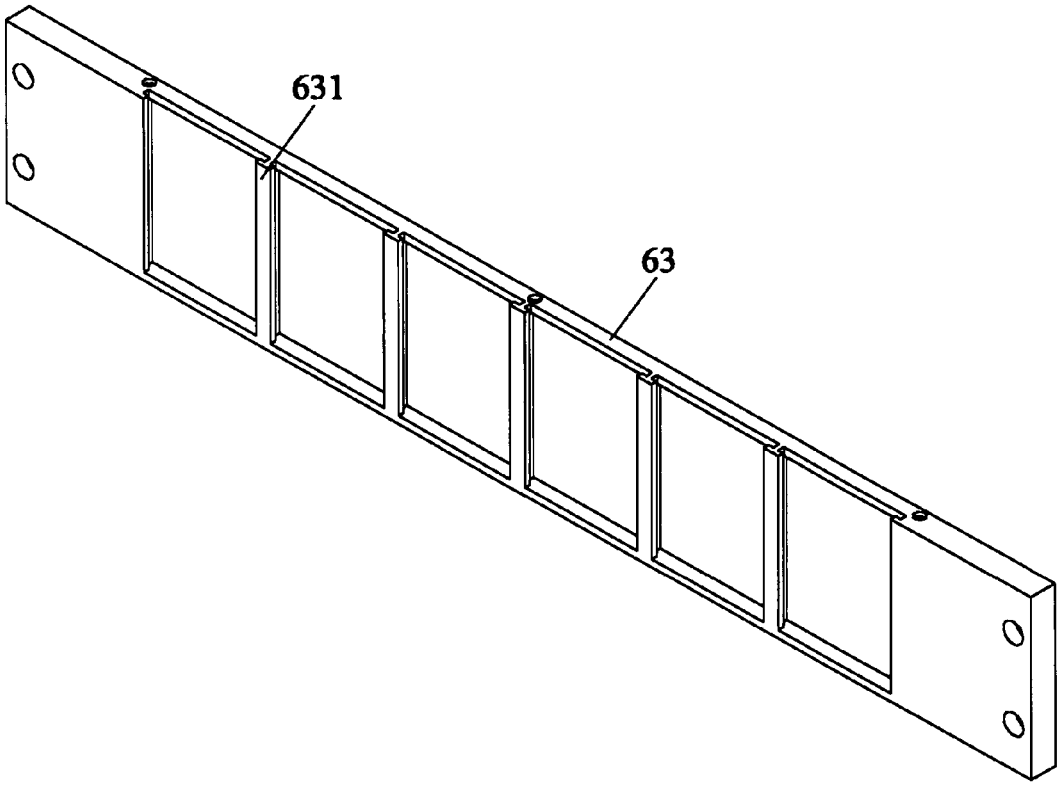
FIG. 7 is a perspective view of a fixing frame of the present invention.
Figure 9:
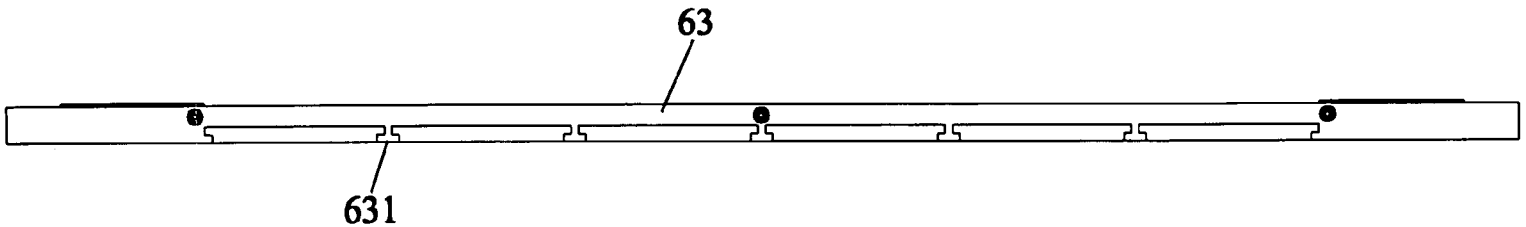
FIG. 9 is a bottom view of the fixing frame of the present invention.
Figure 8:
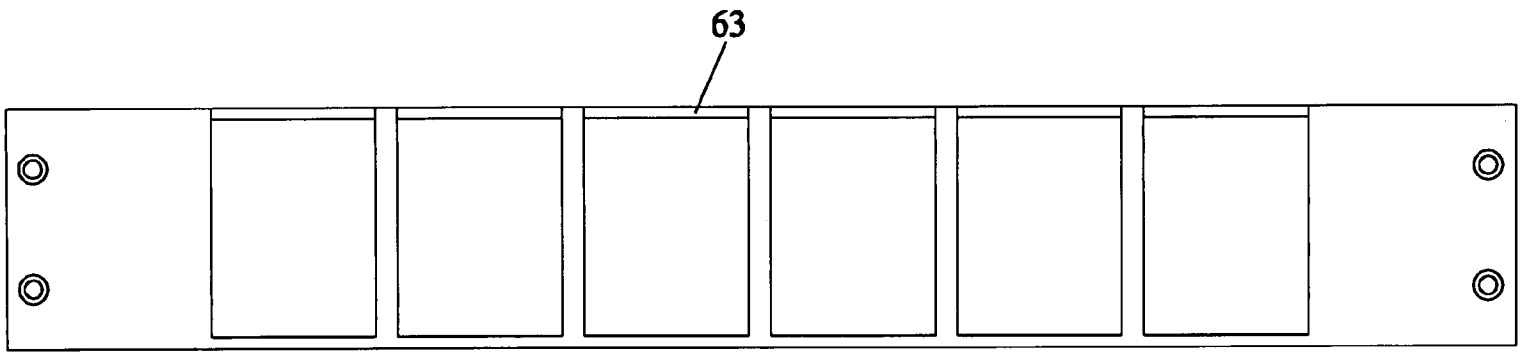
FIG. 8 is a front view of the fixing frame of the present invention.
Figure 10:
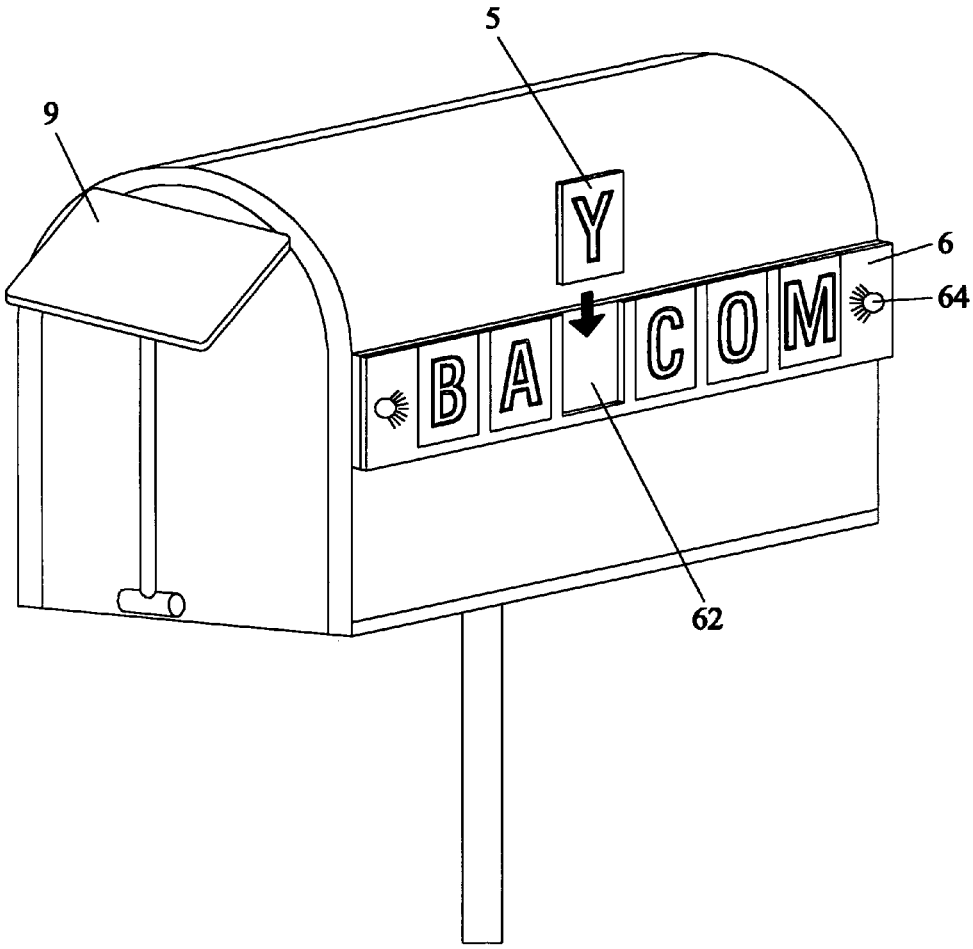
FIG. 10 is a second embodiment view of the present invention.

As shown in FIGS. 5 to 9, the lighting board 5 is consisted of a bottom plate 52 and a film 51. The film 51 is cut with different letter fonts 53, as shown in FIGS. 6 and 10. The lighting fixing structure 6 consists of a fixing plate 61, an optical fiber fabric 62 and a fixing frame 63, wherein the fixing frame 63 has a specified number of fixing end faces 631. The lighting board 5 is fixed between the fixing frames 63, as shown in FIG. 10 that illustrate a second embodiment of the present invention. The lighting fixing structure 6 is fixed on a side face of the mailbox, while lighting units 64 are installed at two ends thereof, providing a guide light to the optical fiber fabric 62.

Figure 11:
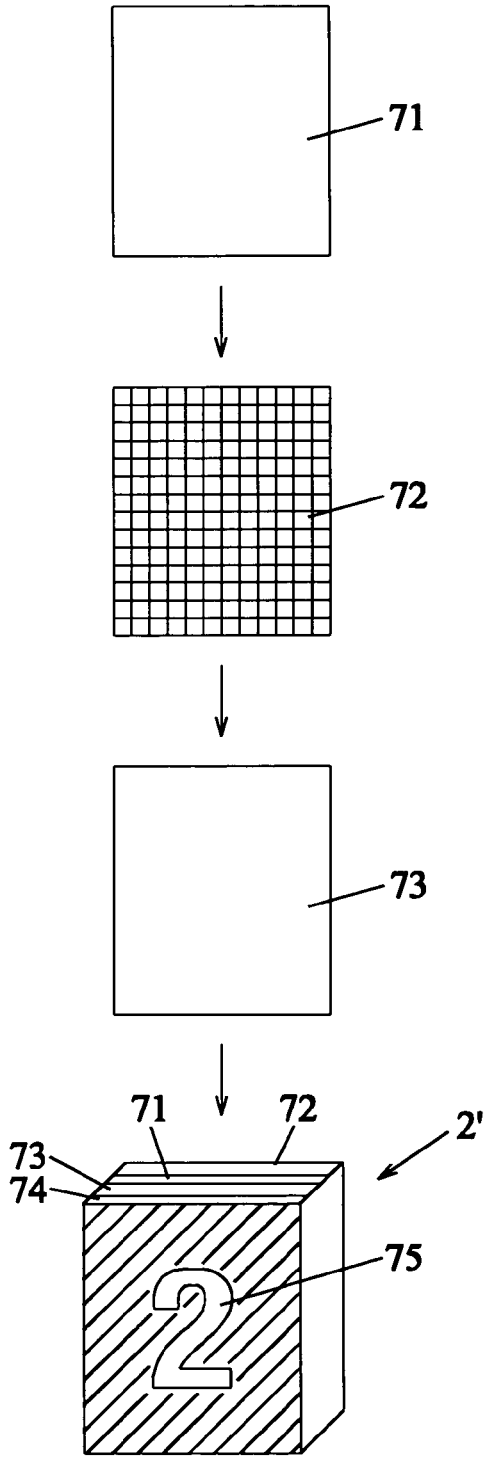
FIG. 11 is a third view of the lighting board structure of the present invention.
Figure 12:
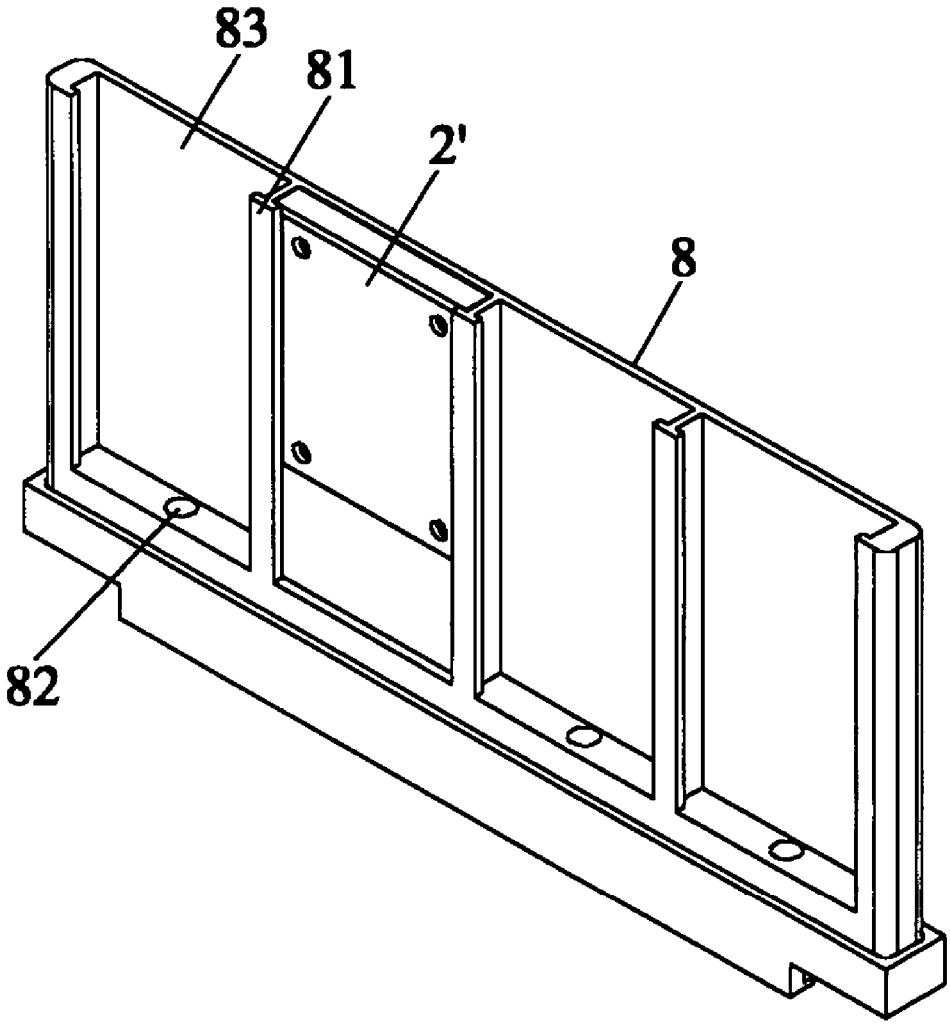
FIG. 12 is a perspective, assembled view of the lighting fixing structure of the present invention.
Figure 15:
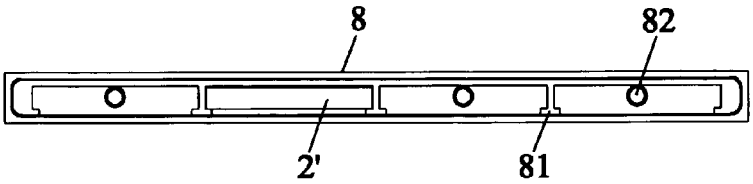
FIG. 15 is a bottom view of the lighting fixing structure of the present invention.
Figure 13:
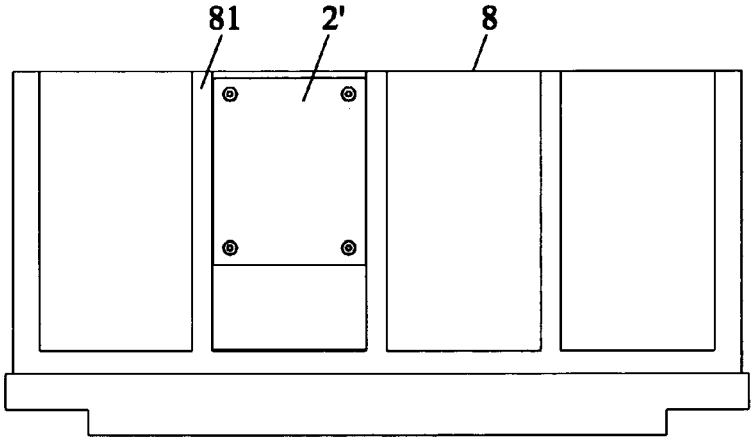
FIG. 13 is a front view of the lighting fixing structure of the present invention.
Figure 14:
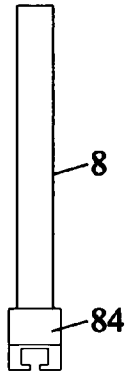
FIG. 14 is a front view of the lighting fixing structure of the present invention.
Figure 16:
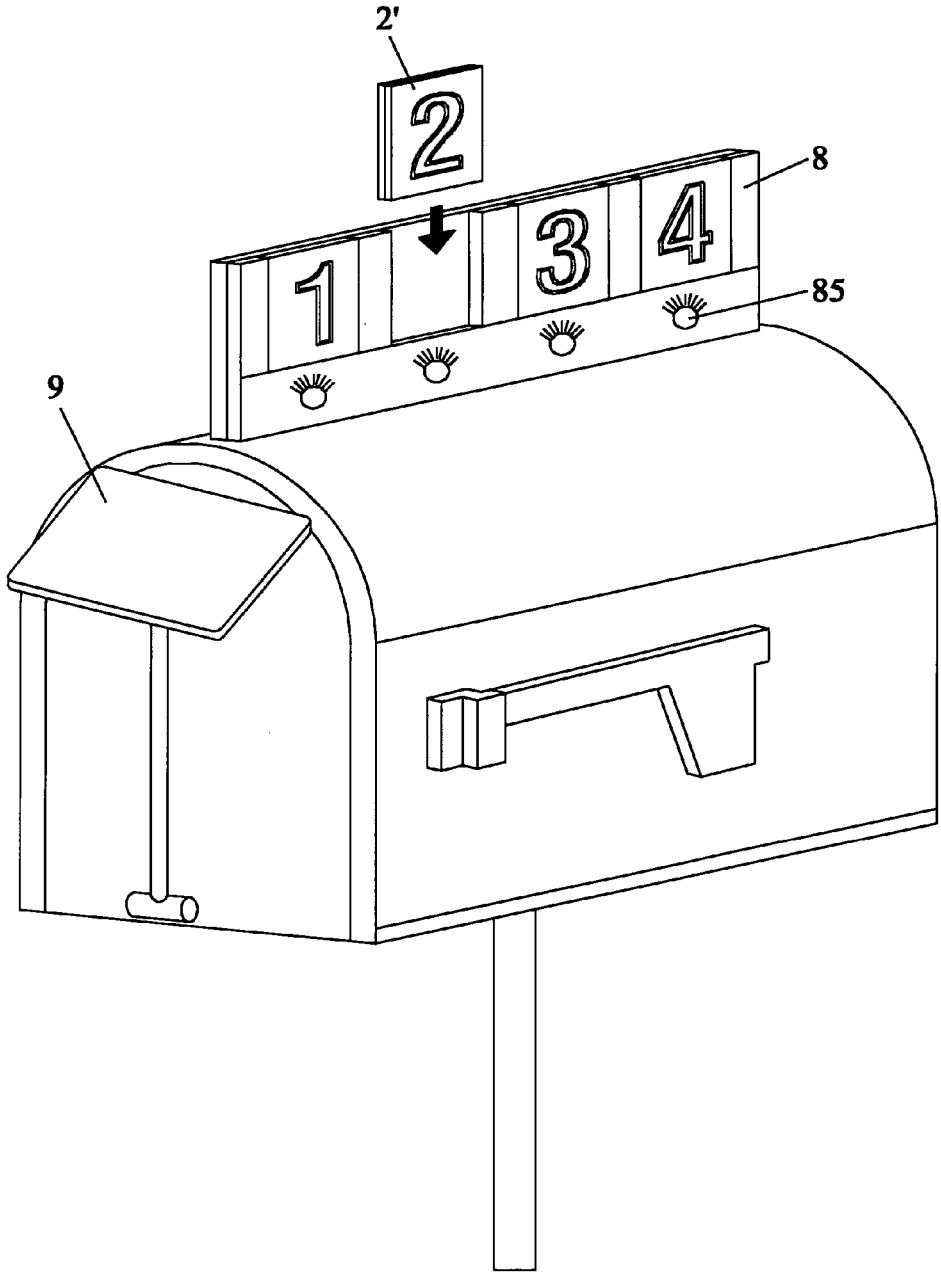
FIG. 16 is a third embodiment view of the present invention.

Please refer to FIGS. 11 to 16, the lighting board structure 2' consists of an optical fiber fabric 71, a bottom plate 72, an upper plywood 73 and a film 74. The film 74 has a letter font 76, as shown in FIG. 11. FIG. 12 shows a lighting fixing structure 8. On the fixing main unit 83 is installed a specified number of fixing end faces 81. Between the fixing end faces 81 is inserted a lighting board structure 2'. At a lower part of the lighting fixing structure 8 is provided a specified number of holes 82 serving to accommodate the insertion of the lighting units 85, as shown in FIG. 14, at a lower part of the fixing structure 8 is installed a base 84. FIG. 15 shows a bottom view of the lighting fixing structure 8, wherein the lighting board structure 2' is placed between the fixing end faces 81. FIG. 16 shows a third embodiment of the present invention, wherein the lighting fixing structure 8 is fixed onto an upper end face of the mailbox, at a lower part of the lighting fixing structure 8 is installed with a number of lighting units 85.

Figure 17:
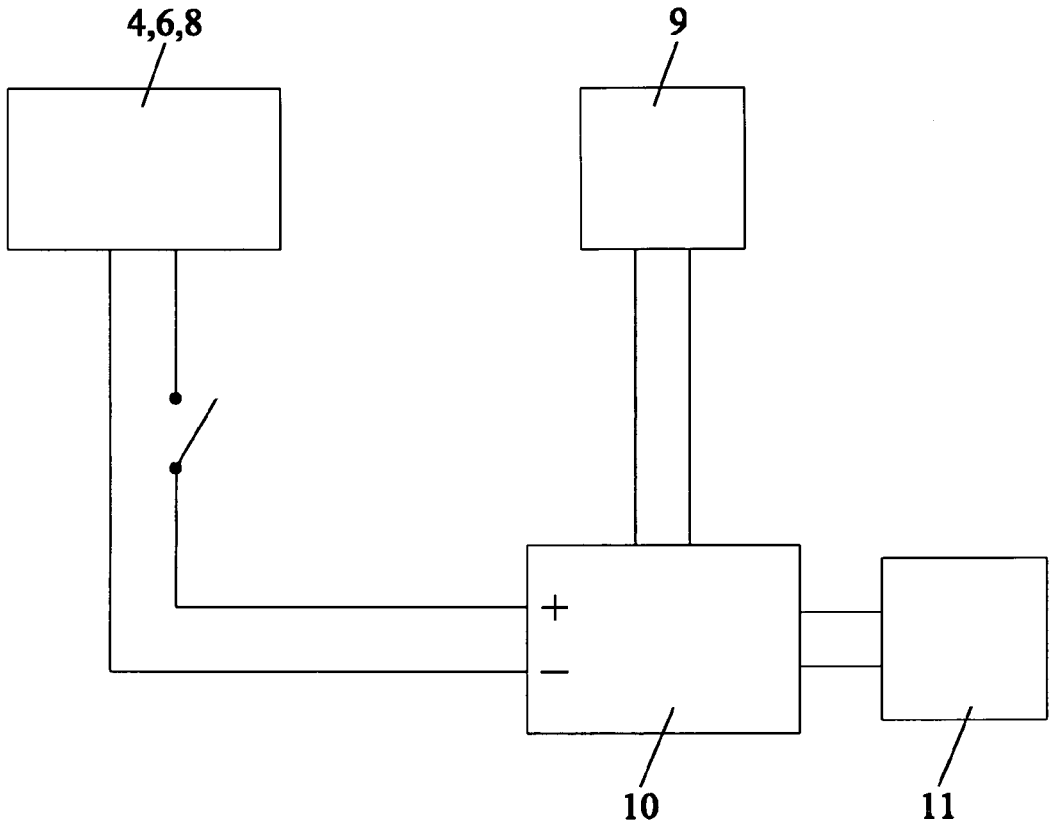
FIG. 17 shows the invention in action of the present invention.

Please refer to FIG. 17, a circuit board 10 is connected to the lighting fixing structures 4, 6, 8, a solar energy board 9 and a battery 11. When power is switched on, the lighting units 2, 64 and 85 are activated to produce light, which in turn enables the optical fiber filament 12 or optical fiber fabric 62, 72 to produce guide light, thereby the lighting board structures 1', 5 and 2' are capable of producing light.

What is claimed is:

1. A mailbox with lighting decorative structure, comprising lighting fixing structures and lighting board structures, wherein:

the lighting board structure consists of combined lighting board and connecting board, a surface of the lighting board is cut with letter font or pattern with a specified depth, an optical fiber filament being inserted inside the cut of the lighting board, the optical fiber filament being connected with the connecting board, a lighting unit being installed at the center of the connecting board connected to a lower part of the lighting board;

the lighting fixing structure consists of a fixing main unit, an upper cover and a receptor unit, wherein a round head is installed on the top side of the upper cover, a receptor head is installed on a lower part of the receptor unit, wherein the lighting board structure is inserted between the upper cover, the receptor unit and the fixing main unit, an additional lighting board structure with different letter font is inserted inside the lighting fixing structure, the lighting fixing structure is fixed onto an upper part or a side face of the mailbox, and connected to a solar energy board.

2. A mailbox with lighting decorative structure, comprised of a lighting fixing structure and a lighting board structure, wherein:

the lighting board structure consists of a bottom plate and a film, wherein the film is cut with different letter font and glued to the bottom plate;

the lighting fixing structure consists of a fixing plate, an optical fiber fabric and a fixing frame, forming a structure having three layers, the fixing frame having a specified number of fixing end faces; wherein, the lighting board structure is inserted and fixed between the fixing end faces, the lighting fixing structure being fixed onto an upper part or a side face of the mailbox, each end thereof of the lighting fixture structure being fitted with a lighting unit providing guide light to the optical fiber fabric, and connected with a solar energy board.

3. A mailbox with lighting decorative structure, comprised of a lighting fixing structure and a lighting board structure, wherein:

the lighting board structure consists of a bottom plate, an optical fiber fabric, an upper unit of plywood and a film, wherein the film is cut with the letter font or a pattern, the lighting fixing structure consists of a fixing main unit having a specified number of fixing end faces, between two fixing end faces being inserted the lighting board structure, on a lower part of the lighting fixing structure being provided with a specified number of holes serving to accommodate the insertion of one or more lighting units, on a lower part of the lighting fixing structure is installed a base, the lighting fixing structure is fixed to an upper part or a side face of the mailbox, on a lower part of the lighting fixing structure is installed a specified number of the lighting units, and the lighting fixing structure is connected to a solar energy board.

* * * * *